US006624722B2

(12) United States Patent
Wang et al.

(10) Patent No.: US 6,624,722 B2
(45) Date of Patent: Sep. 23, 2003

(54) COPLANAR DIRECTIONAL COUPLER FOR HYBRID GEOMETRY

(75) Inventors: Chi Wang, Middletown, NJ (US); William D. Wilber, Neptune, NJ (US)

(73) Assignee: Radio Frequency Systems, Inc., Meriden, CT (US)

( * ) Notice: Subject to any disclaimer, the term of this patent is extended or adjusted under 35 U.S.C. 154(b) by 0 days.

(21) Appl. No.: 09/949,660

(22) Filed: Sep. 12, 2001

(65) Prior Publication Data

US 2003/0048151 A1 Mar. 13, 2003

(51) Int. Cl.[7] ..... H01P 5/18
(52) U.S. Cl. ..... 333/116; 333/117; 333/111
(58) Field of Search ..... 333/116, 117, 333/111, 115, 114, 109

(56) References Cited

U.S. PATENT DOCUMENTS

| | | | | | |
|---|---|---|---|---|---|
| 2,976,499 | A | | 3/1961 | Sferrazza | |
| 3,166,723 | A | | 1/1965 | Bock et al. | |
| 3,516,024 | A | * | 6/1970 | Lange | 333/10 |
| 3,626,332 | A | * | 12/1971 | Barbatoe | 333/116 |
| 3,798,574 | A | | 3/1974 | Workman | |
| 3,904,997 | A | * | 9/1975 | Stinehelfer, Sr. | 333/84 |
| 4,034,289 | A | | 7/1977 | Rozylowicz et al. | |
| 4,139,827 | A | * | 2/1979 | Russell | 333/116 |
| 4,313,095 | A | | 1/1982 | Jean-Frederic | |
| 4,375,053 | A | * | 2/1983 | Viola et al. | 333/116 |
| 4,375,054 | A | | 2/1983 | Pavio | |
| 4,433,313 | A | | 2/1984 | Saint et al. | |
| 4,459,568 | A | | 7/1984 | Landt | |
| 4,476,447 | A | * | 10/1984 | Lauchner | 333/111 |
| 4,677,399 | A | * | 6/1987 | Le Dain et al. | 333/116 |
| 4,737,740 | A | | 4/1988 | Millican et al. | |
| 4,814,780 | A | | 3/1989 | Sterns et al. | |
| 4,928,077 | A | | 5/1990 | Devaux et al. | |
| 4,952,916 | A | | 8/1990 | Taplin | |
| 4,983,933 | A | | 1/1991 | Volk et al. | |
| 5,063,365 | A | | 11/1991 | Cappucci | |
| 5,105,171 | A | | 4/1992 | Wen et al. | |
| 5,111,165 | A | | 5/1992 | Oldfield | |
| 5,309,122 | A | * | 5/1994 | Cox et al. | 333/116 |
| 5,369,379 | A | | 11/1994 | Fujiki | |
| 5,486,798 | A | | 1/1996 | Veitschegger | |
| 5,499,001 | A | | 3/1996 | Degun et al. | |
| 5,521,563 | A | | 5/1996 | Mazzochette | |
| 5,629,654 | A | | 5/1997 | Frick | |
| 5,675,300 | A | | 10/1997 | Romerein | |
| 5,689,217 | A | | 11/1997 | Gu et al. | |
| 5,864,259 | A | | 1/1999 | Persson | |
| 5,883,555 | A | | 3/1999 | Ikari et al. | |
| 5,926,076 | A | | 7/1999 | Johnson et al. | |
| 5,994,977 | A | | 11/1999 | Taya | |
| 5,995,821 | A | | 11/1999 | Tran | |
| 6,081,241 | A | | 6/2000 | Josefsson et al. | |

* cited by examiner

*Primary Examiner*—Robert Pascal
*Assistant Examiner*—Dean Takaoka
(74) *Attorney, Agent, or Firm*—Sughrue Mion, PLLC

(57) ABSTRACT

A microwave coupler has a planar form with a transmission line segment oriented at an angle relative to a main transmission line. The planar form of the transmission line, such as in a printed circuit board, helps reduce the size and manufacturing costs for the coupler. When placed a prescribed distance from the main transmission line and oriented at an appropriate angle, the directivity and coupling factor requirements can be met precisely with minimal tuning. Where fine tuning is required, a tuning screw and resistor disposed adjacent to the transmission line segment are provided.

25 Claims, 6 Drawing Sheets

Figure 1. Drawing of microwave coupler.

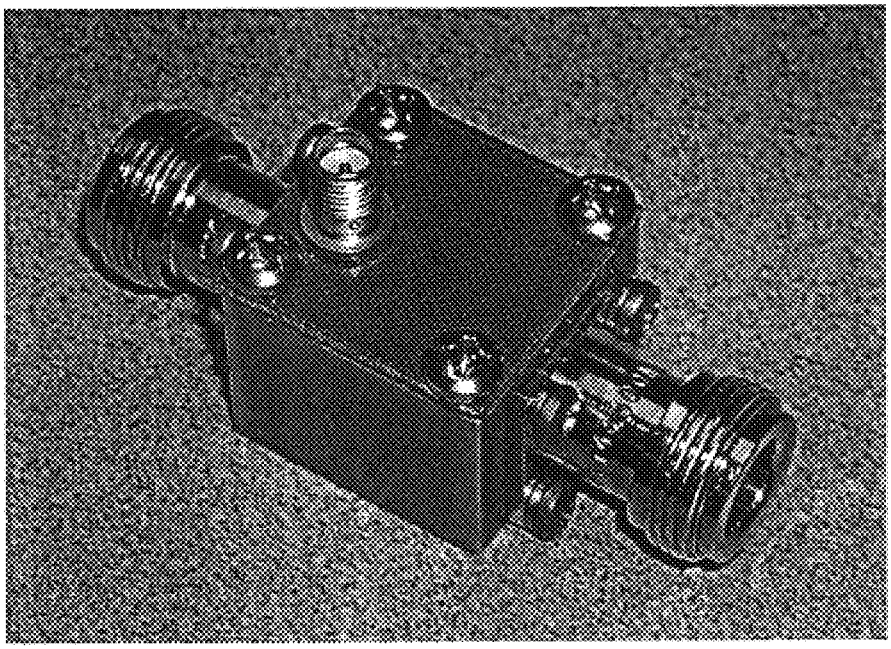
Figure 2. Microwave coupler mounted on top of coaxial test fixture.
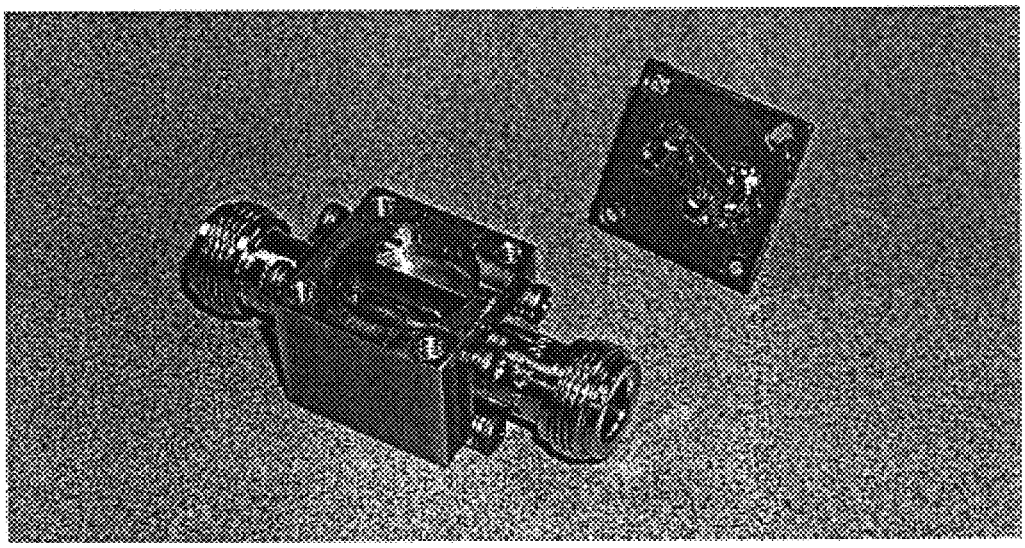
Figure 3. The coupler and test fixture disassembled.

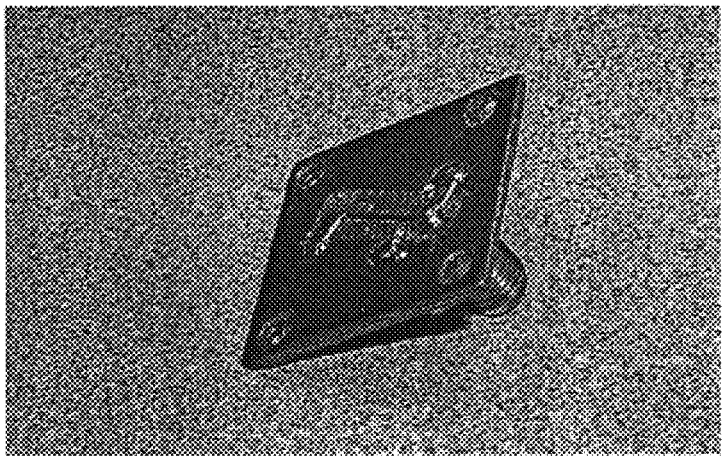
Figure 4. View of coupler showing transmission line of coupler and the connector.
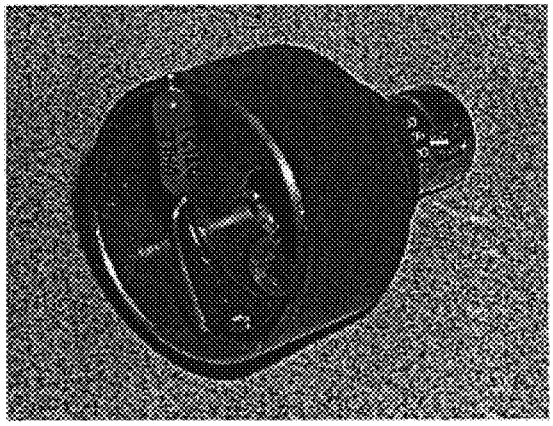
Figure 8. Photograph of prior art coupler.

Figure 5

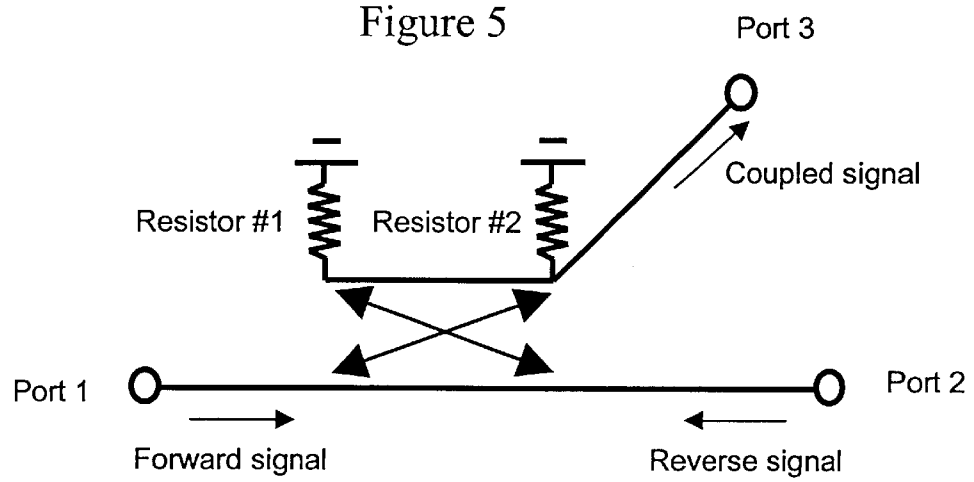

Coupling (dB) = 10*log{(Power of Forward signal)/(Power of Coupled Signal)}

Directivity (dB) = 10*log{(Power into coupler from Forward signal)/(Power into coupler from Reverse signal)}

The above figure shows two coupled transmission lines. The line between port 1 and port 2 is the main transmission line, and the main transmission line is coupled to the neighboring transmission line (coupled line). The coupled line is terminated at one end by Resistor #1, and at the other end by Port 3. Standard definitions for coupling factor and directivity are given. The details of the patent disclosure describe the form/geometry of the coupled lines.

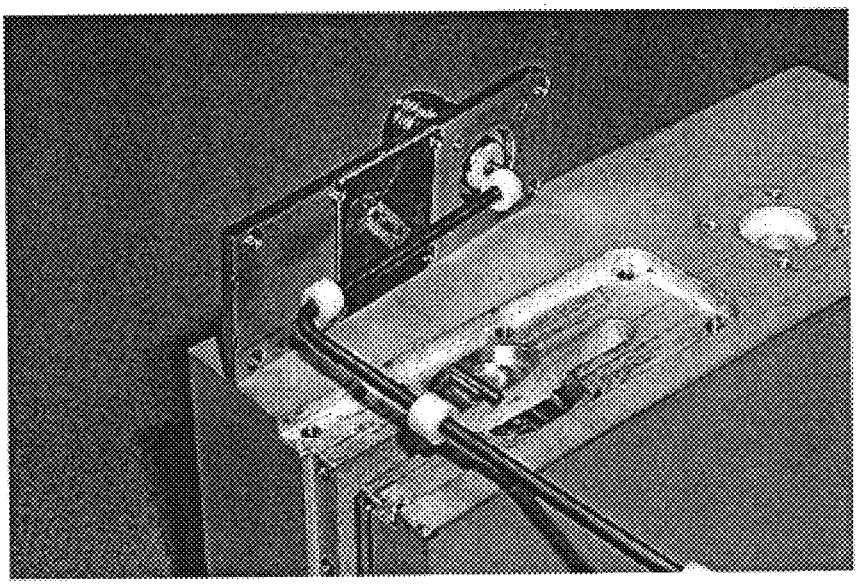
Figure 6. Housing with coupler assembly, showing coplanar coupler (with one resistor) and main transmission line (brass rod).

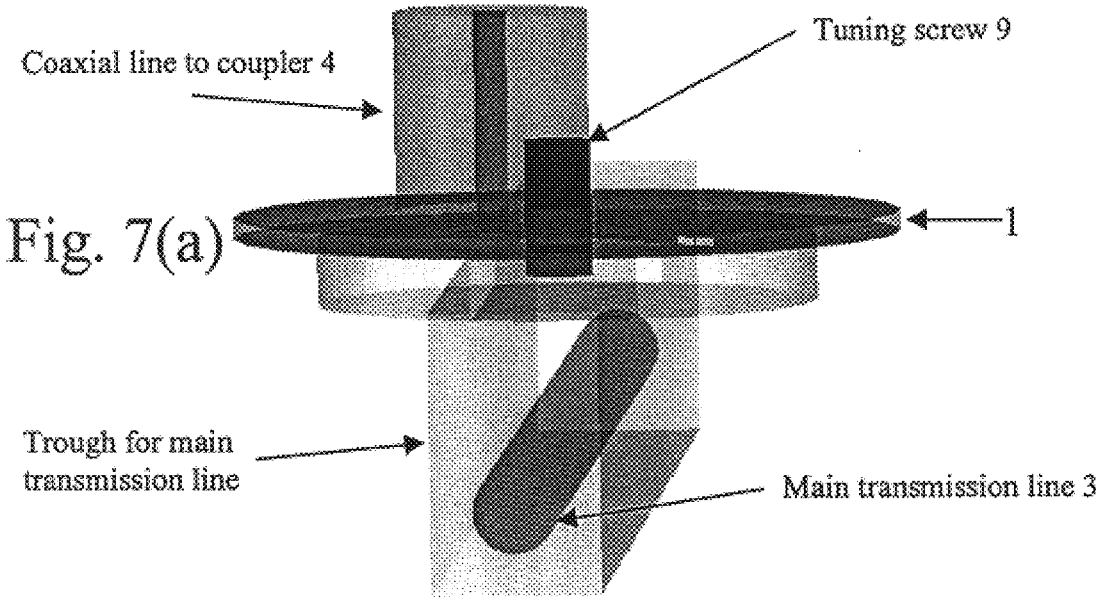
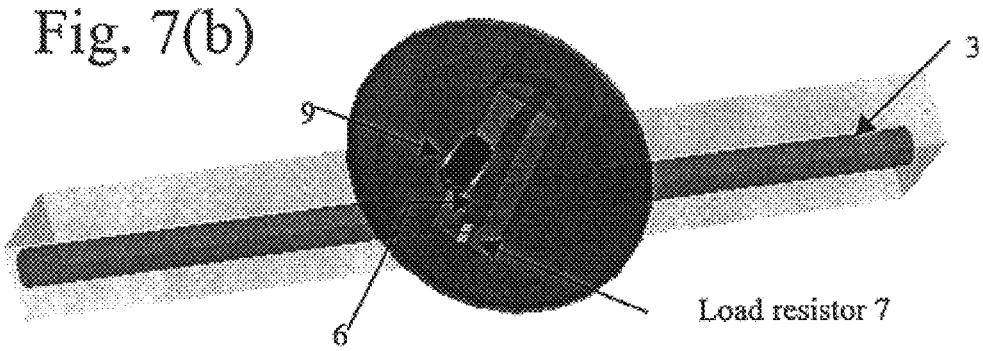
Figure 7. Model used for simulating the effect of a tuning screw applied perpendicular to the plane of the coupler, viewed (a) along the main transmission line, and (b) from the top of the coupler.

COPLANAR DIRECTIONAL COUPLER FOR HYBRID GEOMETRY

FIELD OF INVENTION

The present invention relates to a directional coupler with a high degree of directivity and compact size to facilitate assembly of the coupler and installation of the coupler within a communication system.

BACKGROUND

Description of Related Art

A photograph of a previously known microwave coupler is shown in FIG. 8. The coupler includes a cup-shaped holder with a resistor and a coupling loop disposed on the large-sized opening of the cup. A connector on the back side of the cup is connected to a measurement system or any external circuit. The cup-shaped coupler is disposed in a housing in proximity to a main transmission line. More particularly, the broad opening is disposed to face a main transmission line, and the cup is rotated relative to the transmission line to control the directivity of the coupling and is positioned within the housing closer to or away from the transmission line to control the degree of coupling.

The above tuning process to position the coupler to achieve the target directivity and degree of coupling takes a significant amount of time and effort. Specifically, rotational adjustments for directivity commonly cause variation in the coupling factor and vice versa. Moreover, as the directivity of the coupler is adjusted by rotating the cup, it is possible that during the tuning process, the directivity will be adjusted in the opposite direction to that desired. Due to these difficulties, a coupler can take up to fifteen minutes to tune correctly. A coupler with the above configuration is conventionally mounted in a communications system to take two measurements, 1) to sample an outgoing signal for signal strength, and 2) to sample how much of the transmitted signal is reflected back from a transmit antenna. As each coupler can take up to fifteen minutes to tune correctly, it may take half an hour to adjust couplers for any given transmission channel.

Additionally, due to the number of components that must be hand-assembled, such as the cup, the resistor, coupling wire and connector, the known coupler is also expensive to manufacture, and has a bulky configuration.

SUMMARY OF THE INVENTION

The present invention addresses the above deficiencies. The disclosed invention comprises a coplanar waveguide directional coupler that can be used in conjunction with transmission lines with other waveguide geometries such as a coaxial cable, microstrip and stripline. The coplanar waveguide is formed with a coupling transmission line on a printed circuit board. The coupling line is disposed to face the main transmission line at a predetermined distance to achieve the desired coupling and canted at a particular angle relative to longitudinal direction of the main transmission line to achieve the desired directivity. The coupler includes a load resistor and an optional impedance matching resistor.

When designed for a particular application specified by the coupling factor, directivity, and frequency range, the coplanar coupler of the present invention does not require further tuning. This eliminates the effort in including additional tuning mechanisms during manufacture of the coupler. The ability to precisely design the coupler also eliminates tuning during installation. The coupler also has a compact size compared to known coupler arrangements. The present invention further takes into consideration that the coupling and directivity properties of the designed coplanar coupler may deviate slightly from design parameters to due different manufacturing tolerances in constructing the housing for the main transmission line, for example, as well as electrical tolerances for component resistors and components of the RF sub-systems in which the coupler is used. Therefore, as an additional feature of the present invention, the coupling factor may be fine-tuned by adjusting a tuning screw.

BRIEF DESCRIPTION OF THE DRAWINGS

Preferred embodiments of the invention will be described below with reference to the attached drawings, where:

FIG. 1(*b*) illustrates a plan view of the arrangement of the coupler according to a first embodiment of the invention;

FIG. 2 is a photograph of the coupler assembled with a coaxial test fixture;

FIG. 3 is a photograph of the coupler disassembled from the test fixture of FIG. 2;

FIG. 4 is a photograph of the coupler transmission line and connector;

FIG. 5 is a schematic diagram of the coupler according to a preferred embodiment;

FIG. 6 is a photograph of a coupler arrangement including a tuning screw according to another embodiment of the invention;

FIG. 7(*a*) is a cross-sectional diagram of a coupler arrangement including a tuning screw according to another embodiment of the invention;

FIG. 7(*b*) is a diagram of a plan view of the coupler arrangement of FIG. 7(*a*); and FIG. 8 is a photograph of a conventional coupler.

DESCRIPTION OF PREFERRED EMBODIMENTS

Figure 1A:
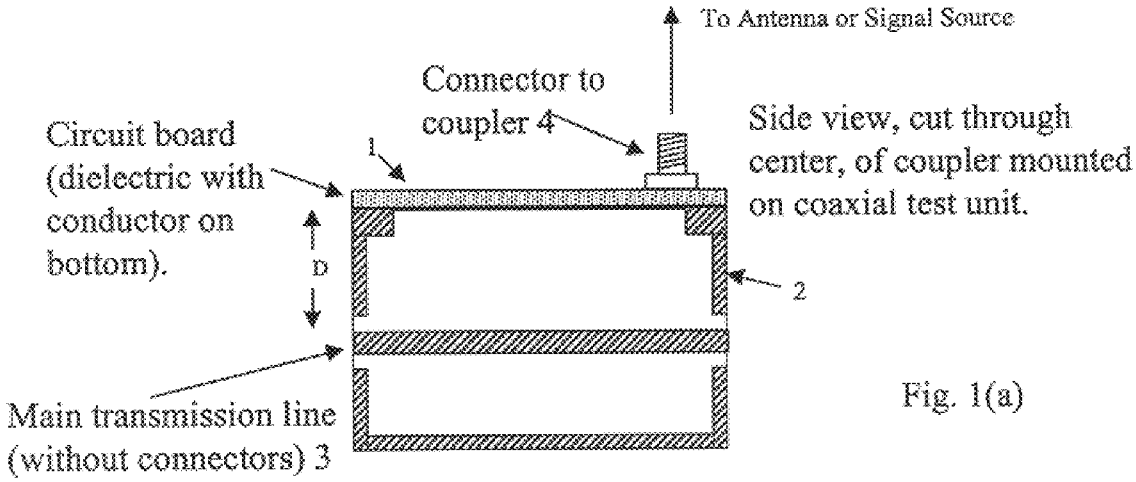
FIG. 1(*a*) illustrates a cross-sectional view of the coupler according to the present invention in relation to a coupled transmission line disposed in a housing.
Figure 1B:
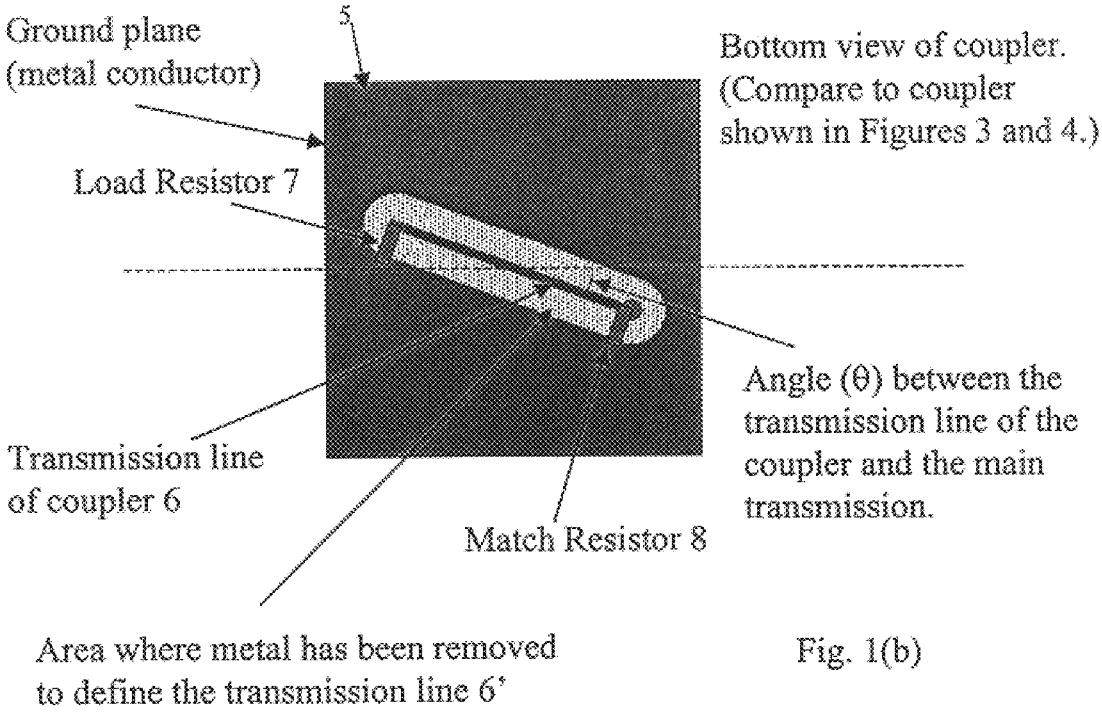

FIG. 1(*a*) illustrates a planar coupler 1 according to a first embodiment of the invention, assembled with a housing 2 and a main transmission line 3. A connector 4 connects the coupler with a measurement device or other RF sub-system. The coupler includes a printed circuit board, with a conductor provided on the plane facing the transmission line 3, and a dielectric on the other plane of the board substrate. Copper may be used as a standard conductor material, but other conducting materials may be used. The housing 2 is designed with a distance D between the transmission line 3 and the bottom face of the coupler to provide a specified coupling factor.

Referring to FIG. 1(*b*), the microwave coupler includes a planar circuit 5 on which a coupling transmission line 6 has been described. The transmission line 6 merely comprises a part of the conductive plate, from which a portion of the conductive material has been removed 6'. The line 6 may be formed by mechanical milling or by chemical wet etch. One skilled in the art would be familiar with how to employ these techniques to form the line, and therefore the details for line formation are omitted. Accordingly, the coupler transmission line is very to manufacture. For the design presented in this disclosure, the length of the transmission line 6 need only be a small fraction of the wavelength of the signal transmitted in a main transmission line. In other words, the quarter length requirement associated with many known conventional coupler configurations is not required. This further aids in providing a compact coupler structure.

As further shown in FIG. 1(*b*), two resistors 7, 8 are placed at either end of the transmission line. Resistor 7 has an influence on the magnitude of the directivity (acting as a load), and Resistor 8 determines the return loss (the impedance match to whatever transmission line the coupler is connected).

The coupling structure may be placed above the transmission line 3 as shown in FIG. 1(*a*), with the transmission line 6 canted away from parallel with respect to the main transmission line (as indicated by the broken line) by some angle θ, as shown in FIG. 1(*b*). The angle θ is critical in determining the directivity of the coupler. In the described embodiment θ≠90°. The angle θ is designed so that the magnetic and electrical coupling will substantially cancel for one direction of signal propagation, and reinforce each other for signal propagation in the opposite direction. The degree of coupling is influenced by the separation D between the coupler and the main transmission line. The angle θ, the resistor (7, 8) values, and the coupler line 6 dimension are designed to optimize the directivity of the microwave coupler.

It is noted that D may comprise the distance D shown in FIG. 1(*a*), indicating a vertical displacement between the coupler line 6 and the main transmission line or may comprise a lateral distance d' between the coupler line 6 and an imaginary plane including the transmission line. In particular, while FIG. 1(*b*) shows the coupler line 6 as intersecting with a plane defined by the longitudinal direction of the transmission line, the coupler need not actually intersect this imaginary plane. For instance, the coupler may be displaced a distance d' from the illustrated position to affect the coupling ratio. What is important is that the coupler line describe an angle relative to a line that runs parallel with the main transmission line.

For a given design specification for directivity and coupling factor in a frequency range, one skilled in the art can determine 1) the appropriate displacement between the main transmission line and the coupler line 6 formed on the printed circuit board 5; 2) the angle θ between a line running parallel to the main transmission line and a line parallel to the coupler line; and 3) resistor values. As examples, approximate values for the angle θ and displacement D can be determined using a circuit simulator such as Eesof from Agilent Technologies. Once approximations are found, more precise values can be determined from three-dimensional simulations using HFSS (High Frequency Structure Simulator) sold by Ansoft Corp., Pittsburgh, Pa. or Microwave Studio sold by CST GmbH, Darmstadt, Germany. Although certain simulators to determine the coupler component and design values are mentioned here, the invention is not limited by the technique in which the parameters for the angle θ, distance D, resistor values or dimensions for the coupler line are obtained.

For one particular design, θ was set equal to 22.5 degrees, load resistor value (7) was approximately 120 ohms, matching resistor value (8) was approximately 56 ohms, and the coupler line length was approximately 1.5 cm. The line width was 0.070 inches. The separation between the coupler line and the center of the main transmission line (a coaxial line in the preferred embodiment) was approximately 0.9 cm. The resulting coupler showed 50 dB coupling with 30 dB of directivity at approximately 890 MHz. It is noted that this specific example of a microwave coupler met coupling requirements ±0.5 dB in the frequency range of 824 to 894 MHz. The coupling factor changed from 50 dB at 890 MHz to 49.1 dB at 1,000 MHz.

A photograph of the assembled test unit is shown in FIG. 2. FIG. 3 shows the test unit disassembled. In FIG. 3 the coupler planar transmission line is visible, as well as the coaxial main transmission line. FIG. 4 shows the coupling structure with the attached connector.

FIG. 5 is a schematic illustration of the described embodiment. Schematically, the present invention is similar to known coupler configurations, but with significantly reduced physical size and no tuning requirements. The coupling factor and the directivity are provided by standard relationships as follows:

$$\text{Coupling(dB)} = 10\log\frac{\text{Power of Forward Signal}}{\text{Power of Coupled Signal}}$$

$$\text{Directivity(dB)} = 10\log\frac{\text{Power into coupler Forward Signal}}{\text{Power into coupler Reverse Signal}}$$

It should be pointed out that many couplers exist where the coupling line and the main transmission line exist in the same waveguide geometry. That is, both lines are coaxial, or both lines are microstrip. This coupler works particularly well for a coaxial line, even though the coupler line is planar.

Description of Second Embodiment

Despite the selection of an appropriate angle θ, displacement D (or d') and resistor values, tuning may be required for instances where the specified tolerances cannot be achieved without tuning due to the mechanical tolerances of the fabrication of the planar coupler structure or the housing, and the electrical tolerances of the main transmission line, the resistor(s) and other RF subsystems connected to the coupler structure. The need for tuning will be determined by the acceptable coupler tolerances for each particular application. For precise coupling requirements, such as ±0.5 dB, tuning is likely to be required. For less stringent design requirements, such as ±2 dB, the tuning structure may not be necessary.

FIG. 6 shows the additional tuning screw protruding through the sidewall of the trough that contains the main transmission line. The tuning screw is positioned such that, when it advances into the trough of the main transmission line, it moves closer to the planar coupler structure. There is no variation in the physical dimensions of any line components during tuning by turning of the screw. It is noted that FIG. 6 shows the coupler assembly detached from the main housing. As the tuning screw advances into the housing, it will shield the coupler from some of the electric field, and the coupled power will decrease. FIG. 6 shows this tuning screw positioned near the center of the coplanar coupler, but it need not be centered, but must be close enough to have an effect on the electric field at the coupler.

In addition to the particular geometry shown for the tuning screw in FIG. 6, the tuning screw can be positioned in other ways in order to tune the coupler. FIGS. 7(*a*) and 7(*b*) show two views of a model created to simulate the tuning ability of a screw traveling 9 perpendicular to the plane of the coupler. The remaining reference numerals correspond to elements described in connection with the first embodiment of the invention. This particular example shows the screw cutting through part of the ground plane and through part of the gap between the ground plane and the coupler line. This particular geometry was simulated using electromagnetic modeling software, and showed a tuning range similar to the tuning screw shown in FIG. 6. The tuning geometry chosen for a particular application will depend, among other things, upon the ease of fabrication and accessibility to the tuner given the constraints of the particular application.

Description of Third Embodiment

To further reduce assembly costs for the coupler, the present inventors determined that the preferred embodiment can be modified to include only a single resistor for satisfactory operation.

The prototype coupler of FIG. 6 uses only one resistor (the load resistor 7, seen as the small, black rectangle at the end of the center coplanar line) and still achieves more than 20 dB of directivity with a coupling of 50 dB. The second resistor may be eliminated from the prototype design presented by the proper choice of coplanar transmission line dimensions and load resistor (FIG. 1(*b*), 7) value. Resistor 8 may still be necessary in some designs where the coplanar dimensions are limited because of the coupling values required and/or because of the geometry of the main transmission line.

For the coupler design including a single resistor, a resistor value of 50 ohms and an angle θ of 45 degrees provided a coupling factor of 50 dB, and a directivity of 30 dB. For this single-resistor example, the line length of 0.041 inches, and the line width was 0.09 inches. For the single resistor design, the single resistor will typically be very close to 50 ohms if one is matching to a 50 ohm line. In other words, if the coupler is connected to a 50 ohm transmission line, then the resistor will have a value close to 50 ohms. There can be situations where the impedance of what the coupler connects to is something other than 50 ohms. In that case the resistor would need to be changed appropriately, as would the dimensions of the coupler line itself.

While the present invention has been described with reference to specific preferred embodiments, the invention is not limited thereto. One skilled in the art would understand that various modifications may be made without departing from the spirit and the scope of the present invention.

What is claimed is:

1. A coupler for coupling a signal in a main transmission line, said coupler comprising:

a transmission line segment formed on a planar substrate, said transmission line segment oriented on a surface of the planar substrate to form a non-zero angle with respect to a line running parallel to said main transmission line, wherein said main transmission line is formed in a different plane than the planar substrate of said transmission line segment, wherein the main transmission line and said transmission line segment comprise different waveguide media.

2. The coupler of claim 1, wherein said non-zero angle θ is such that $\theta \neq 90°$.

3. The coupler according to claim 2, wherein said transmission line segment includes a resistor connected to at least one end of the transmission line segment.

4. The coupler according to claim 3, further comprising a tuning screw which includes a shaft which is disposed perpendicular to a face of said planar substrate and adjacent to said transmission line segment.

5. The coupler according to claim 3 further comprising a tuning screw which includes a shaft which is disposed parallel to a face of said planar substrate and between said transmission line segment and said main transmission line.

6. The coupler according to claim 1, wherein the transmission line segment includes a first free terminal end and a second free terminal end.

7. The coupler according to claim 6, further comprising a first resistor disposed at the first free terminal end.

8. The coupler according to claim 7, further comprising a second resistor disposed at the second free terminal end.

9. The coupler according to claim 2, wherein said transmission line segment intersects an imaginary plane including a length of said main transmission line.

10. The coupler according to claim 2, wherein said planar substrate comprises a planar conducting surface with a pattern of conducting material removed to form said transmission line segment.

11. The coupler according to claim 2, wherein said main transmission line comprises a coaxial cable.

12. The coupler according to claim 2, wherein said coupler is connected between an antenna and a signal source in a microwave communication system.

13. The coupler of claim 2 further comprising a tuning screw disposed adjacent to said transmission line segment.

14. The coupler according to claim 13, wherein said tuning screw is movable relative to said transmission line segment and when moved, said tuning screw does not vary physical dimensions of said transmission line segment or said main transmission line .

15. The coupler according to claim 13, wherein said tuning screw includes a shaft which is disposed perpendicular to a face of said planar substrate.

16. The coupler according to claim 13, wherein said tuning screw includes a shaft which is disposed parallel to a face of said planar substrate between said transmission line segment and said main transmission line.

17. A coupler comprising:

a planar metallic surface having at least one straight edge, a portion of the planar metallic surface having metal removed in a pattern to describe a straight transmission line segment having a first terminal end and a second terminal end, said transmission line segment being oriented such that a first imaginary line including said transmission line segment crosses over a second imaginary line including said one straight edge, wherein the first terminal end and the second terminal end are free ends.

18. The coupler according to claim 17, further comprising a resistor at the first terminal end.

19. The coupler according to claim 18, further comprising a second resistor at the second terminal end.

20. The coupler according to claim 17, wherein said first imaginary line including said transmission line segment crosses said second imaginary line including said one straight edge at an angle other than 90°.

21. The coupler according to claim 20, further comprising a resistor connected to said transmission line segment.

22. The coupler according to claim 21, further comprising a tuning screw disposed adjacent to said transmission line segment, wherein said tuning screw is movable relative to said transmission line segment and does not vary a physical dimension of said transmission line segment.

23. The coupler according to claim 22, wherein said tuning screw includes a shaft which is disposed perpendicular to said planar metallic surface.

24. The coupler according to claim 22, wherein said tuning screw includes a shaft which is disposed parallel to said planar metallic surface.

25. The coupler according to claim 20, wherein said coupler is disposed between an antenna and a signal source in a microwave communication system.

* * * * *